US012545367B1

(12) United States Patent
Egan

(10) Patent No.: US 12,545,367 B1
(45) Date of Patent: Feb. 10, 2026

(54) NOISE REDUCTION DEVICE FOR WATERCRAFTS

(71) Applicant: Timothy W. Egan, Greensboro, NC (US)

(72) Inventor: Timothy W. Egan, Greensboro, NC (US)

(73) Assignee: Blue Timber Products, LLC, Greensboro, NC (US)

( * ) Notice: Subject to any disclaimer, the term of this patent is extended or adjusted under 35 U.S.C. 154(b) by 519 days.

(21) Appl. No.: 18/159,811

(22) Filed: Jan. 26, 2023

(51) Int. Cl.
*B63B 17/02* (2006.01)
*B63B 17/00* (2006.01)
*B63H 20/32* (2006.01)

(52) U.S. Cl.
CPC ..... *B63B 17/0081* (2013.01); *B63B 17/02* (2013.01); *B63H 20/32* (2013.01)

(58) Field of Classification Search
CPC ..... B63B 17/00; B63B 17/0081; B63B 17/02; B63H 20/00; B63H 20/02; B63H 20/32; B63H 21/00; B63H 21/36
USPC ..... 114/343
See application file for complete search history.

(56) References Cited

U.S. PATENT DOCUMENTS 10,843,780 B2 * 11/2020 Willard ..... B63H 20/32
11,056,092 B2 * 7/2021 Weston ..... B32B 3/08

* cited by examiner

*Primary Examiner* — Lars A Olson
(74) *Attorney, Agent, or Firm* — Tuggle Duggins P.A.; Blake P. Hurt

(57) ABSTRACT

A noise reduction device for watercrafts that is positioned on a deck of the watercraft and faces an outboard motor of the watercraft. The noise reduction device includes a mount that may be affixed to the deck of the watercraft with a fastener. The mount includes a channel for receiving a panel. The channel may be angled toward the outboard motor so that the panel is angled toward the outboard motor when positioned within the channel. The panel may be formed from a material that reflects and/or absorbs sound that may be generated from the outboard motor, specifically a lower portion of the outboard motor including the exhaust port. The panel may also absorb and/or reflect sound generated from waves, wind, vibrations and the power head of the motor.

20 Claims, 6 Drawing Sheets

NOISE REDUCTION DEVICE FOR WATERCRAFTS

FIELD OF THE INVENTION

The disclosure herein pertains to noise reduction devices generally, and particularly pertains to a noise reduction device that reduces noise generated from a watercraft motor, waves, watercraft vibration, and wind by deflecting sound waves away from the passenger seating area.

DESCRIPTION OF THE PRIOR ART AND OBJECTIVES OF THE INVENTION

Boating is a recreational activity enjoyed by many individuals. Whether on sea, lake, river, or any body of water, the act of cruising around on a watercraft is often an enjoyable group activity where individuals may relish in the company and conversations of others while taking in the surrounding environment and engaging in other activities such as waterskiing or tubing.

A common complaint among many boaters is that boats (e.g. the engine, motor, exhaust port, drive shaft, vibrations, other sounds channeled by a deployed awning or bimini top or roof-like structure of a watercraft, etc.) and their surroundings (e.g. wind, waves, other watercrafts, etc.) are loud and drown out the sounds that patrons design to hear like music and speech; this may be especially true when the boat is accelerating or maintaining forward or backward velocity. Particularly in pontoon boats, which are well known in the prior art and are designed to provide an on-deck environment with a large amount of seating to facilitate easy conversation, the sound of the watercraft and surroundings may drown out the conversation of the passengers making it difficult for passengers to hear each other speak and meaningfully respond to conservations directed at their person.

The prior art has attempted to reduce the noise that plague many boats. Outboard motor covers are soundproof deformable sheets that are configured to cover a top portion of an outboard motor. However, covering the top portion of an outboard motor may reduce noises emitted from the powerhead of the motor, but it may fail to reduce the noise from the lower portion of the motor (i.e. exhaust port, exhaust housing, water intake, anti-ventilation plate, skeg, mounting bracket, and propellor). In some models of outboard motors, the lower portion of the motor may generate more noise than a top portion of the motor, resulting in a significant amount of sound still reaching a portion of the boat deck where passengers are conversing and drown out the conservation. Other methods of soundproofing a watercraft may be to apply soundproofing materials to one or more surfaces of the watercraft such as under seat storage, back seats or the hull of the boat; however this may require a significant amount of soundproofing material and may not significantly reduce outboard motor noise, especially if the passenger is positioned between the outboard motor and the soundproofing material. It follows that the available prior art is largely insufficient because it fails to reduce noise emanating from the lower portion of the motor and may require significant amounts of material to be a viable solution.

Thus, in view of the problems and disadvantages associated with prior art devices, the present disclosure was conceived and one of its objectives is to provide a noise reduction device for boats that may be positioned on the deck of the watercraft.

It is another objective of the present disclosure to provide a noise reduction device for boats that may be positioned between a motor and a passenger.

It is still another objective of the present disclosure to provide a noise reduction device for boats that reduces noise generated from a bottom or lower portion of the motor.

It is yet another objective of the present disclosure to provide a noise reduction device for boats that reduces noise generated from wind, water, vibrations, and the motor.

It is a further objective of the present disclosure to provide a noise reduction device for boats that includes a removable panel configured to reduce noise that moves in the direction of the front of a boat that is generated from the motor.

It is still a further objective of the present disclosure to provide a noise reduction device for boats that includes a channel configured to receive the removable panel therein.

It is yet a further objective of the present disclosure to provide a noise reduction device for boats that includes an elongated base that may be affixed or removably attached to a surface of the watercraft, preferably a surface near the motor of the watercraft.

It is another objective of the present disclosure to provide a noise reduction device for boats that includes a removable panel disposed within an angled channel so that the removable panel is angled toward the motor of the watercraft.

Various other objectives and advantages of the present disclosure will become apparent to those skilled in the art as a more detailed description is set forth below.

SUMMARY OF THE INVENTION

The aforesaid and other objectives are realized by providing a noise reduction device for boats that includes a mount and a removable panel. The mount includes a base. The base may be shaped as an elongated rectangle. The base defines a first longitudinal end and a second longitudinal end, wherein a first sidewall extends from the first longitudinal end and a second sidewall extends from the second longitudinal end. The first and second sidewalls are parallel with one another and extend upward and at an angle relative to the top surface of the base. The second sidewall preferably defines an obtuse angle relative to the top surface of the base whereas the first sidewall defines an acute angle relative to the top surface of the base. The first and second sidewalls, and the base define a channel. The channel is configured to receive a portion of the removable panel configured to reflect sound. The removable panel is configured to frictionally engage a portion of one or both of the first and second sidewalls.

The noise reduction device for boats is positioned on a surface of the watercraft near a motor, preferably an outboard motor. The second sidewall is positioned nearest the outboard motor. Wherein the removable panel is at an angle toward the motor of about sixty to eighty-five (60 to 85) degrees and is configured to reflect and/or reduce sound generated from the motor, and particularly sound generated from a lower portion of the motor. The panel may also reflect and/or reduce sound moving in the direction from the rear of the watercraft to the front of the watercraft where passengers may be positioned, such as but not limited to sound generated from waves, wind, other watercrafts, vibrations, and the like.

DETAILED DESCRIPTION OF THE PREFERRED EMBODIMENT AND OPERATION OF THE INVENTION

Figure 1:
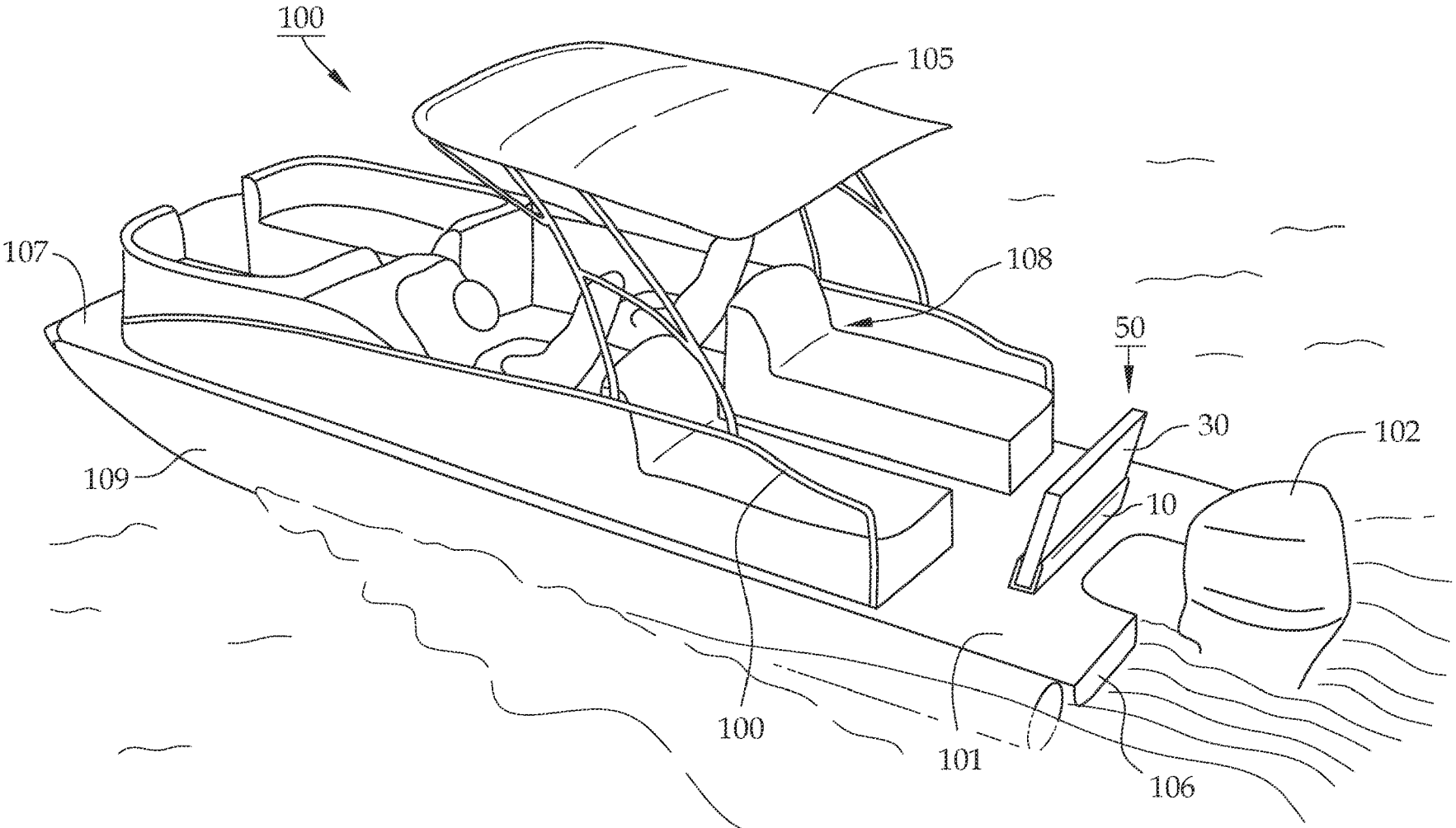
FIG. 1 shows an elevated perspective view of the noise reduction device for watercrafts positioned on a deck of a watercraft near an outboard motor.

Various exemplary embodiments of the present disclosure are described below. Use of the term "exemplary" means illustrative or by way of example only, and any reference herein to "the disclosure" is not intended to restrict or limit the disclosure to exact features or step of any one or more of the exemplary embodiments disclosed in the present specification. References to "exemplary embodiment", "one embodiment", "an embodiment", "various embodiments", and the like may indicate that the embodiment(s) of the disclosure so described may include a particular feature, structure, or characteristic, but not every embodiment necessarily incudes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the disclosure or to imply that certain features are critical, essential, or even important to the structure or function of the disclosure. Rather, these terms are merely intended to highlight alternative or additional features that may or may not be utilized in a particular embodiment of the present disclosure.

The present disclosure is described more fully hereinafter with reference to the accompanying figures, in which one or more exemplary embodiments of the disclosure are shown. Like numbers used herein refer to like elements throughout. The disclosure may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the disclosure, and any and all equivalents thereof. Moreover, many embodiments such as adaptations, variations, modifications, and equivalent arrangements will be implicitly disclosed by the embodiments described herein and fall within the scope of the instant disclosure.

Although specific terms are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. Where only one item is intended, the terms "one and only one", "single", or similar language is used. When used herein to join a list of items, the term "or" denotes at least one of the items but does not exclude a plurality of items of the list.

For exemplary methods or processes of the disclosure, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present disclosure.

Additionally, any references to advantages, benefits, unexpected results, or operability of the present disclosure are not intended as an affirmation that the disclosure has previously been reduced to practice or that any testing has been performed. Likewise, unless stated otherwise, use of verbs in the past tense (present perfect or preterit) is not intended to indicate or imply that the disclosure has previously been reduced to practice or that any testing has been performed.

For a better understanding of the disclosure and its operation, turning now to the drawings, FIG. 1 illustrates the noise reduction device for watercrafts 50 positioned on a watercraft 100, preferably a boat, and more preferably a pontoon boat. The noise reduction device 50 is configured and positioned to reflect and/or reduce sound from a noise source such as motor 102, for example an outboard motor.

In the preferred embodiment, the noise reduction device 50 is positioned on the deck 101 of the watercraft 100. The deck 101 is defined as a flat or substantially flat surface near the motor 102 that is capable of receiving the noise reduction device 50. The noise reduction device 50 is configured to face and be angled toward the motor 102 and be positioned a distance 40 from motor 102 (seen in FIG. 2). In the most preferred embodiment, the distance 40 defines a value that is the smallest possible distance between the motor 102 and the noise reduction device 50 without interfering with movement of the motor 102 and/or air intake of the motor 102. The noise reduction device 50 may be configured to reflect, reduce, and/or absorb sound waves 70 emanating from the motor 102. It should be understood that the noise reduction device 50 may be most effective at reducing, reflecting, and/or absorbing sound waves 70 that are generated when the watercraft 100 is in motion. In one or more embodiments, the noise reduction device 50 may be configured to reflect, reduce, and/or absorb sound waves emanating from other sound sources such as water waves, wind, and/or vibrations, traveling in the direction from the rear 106 of the watercraft 100 to the front 107 of the watercraft 100. In scenarios where an awning 105, or bimini top 105, is deployed on the watercraft 100, such as seen in FIG. 1, noise reaching a front 107 of the watercraft 100 or a seating area 108 of the watercraft 100 may be intensified due to a channeling and/or funneling effect that the awning 105 may have on sound emanating from the motor 102. The noise reduction device 50 may reduce noise reaching the front 107 of the watercraft 100 or the seating area 108 of the watercraft 100 from intensifying while the awning 105 is deployed by reducing and/or reflecting noise emanating from the motor 102 that otherwise may have been directed toward the awning 105.

Figure 2:
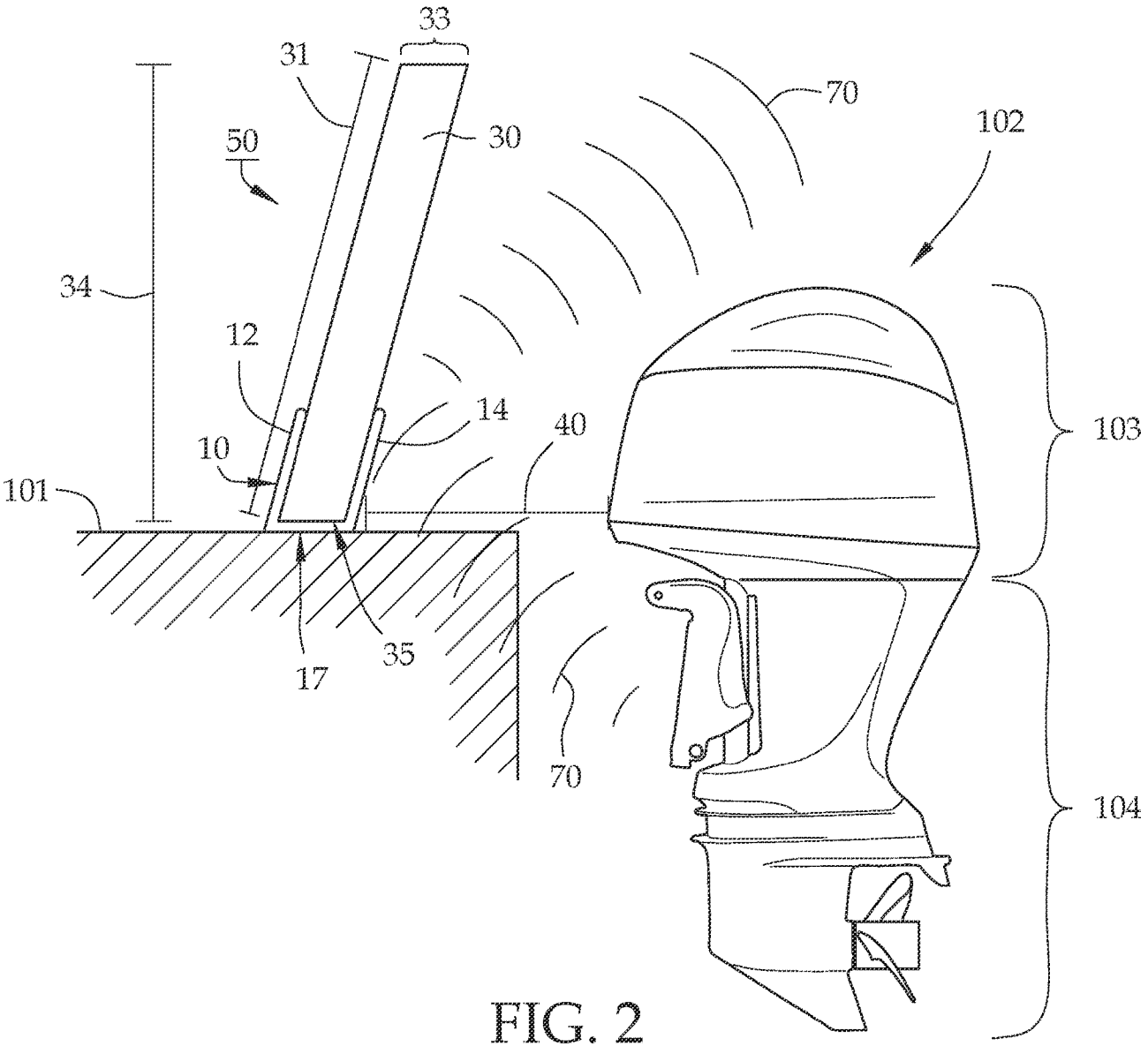
FIG. 2 pictures an elevated side view of the noise reduction device for watercrafts positioned on a deck of watercraft near an outboard motor.
Figure 3:
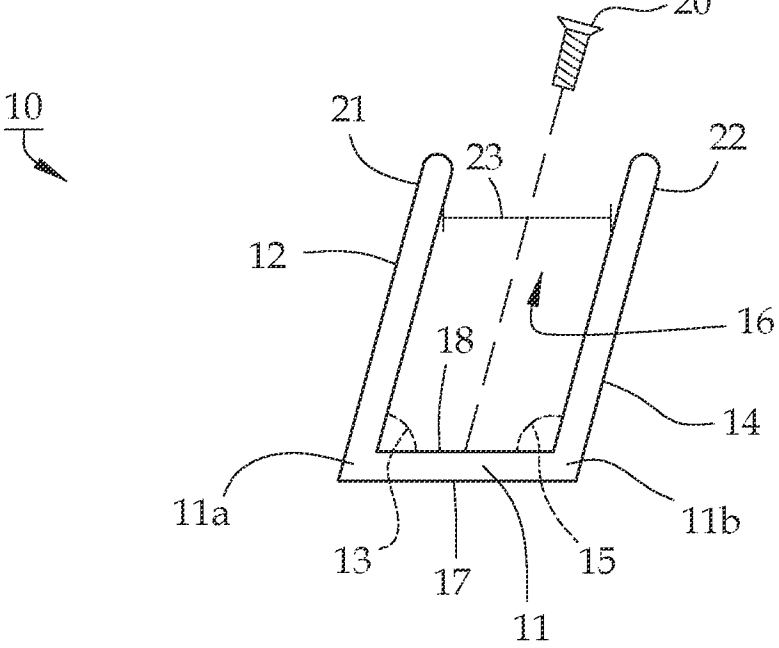
FIG. 3 depicts an elevated side view of the mount of the noise reduction device for watercrafts.
Figure 4:
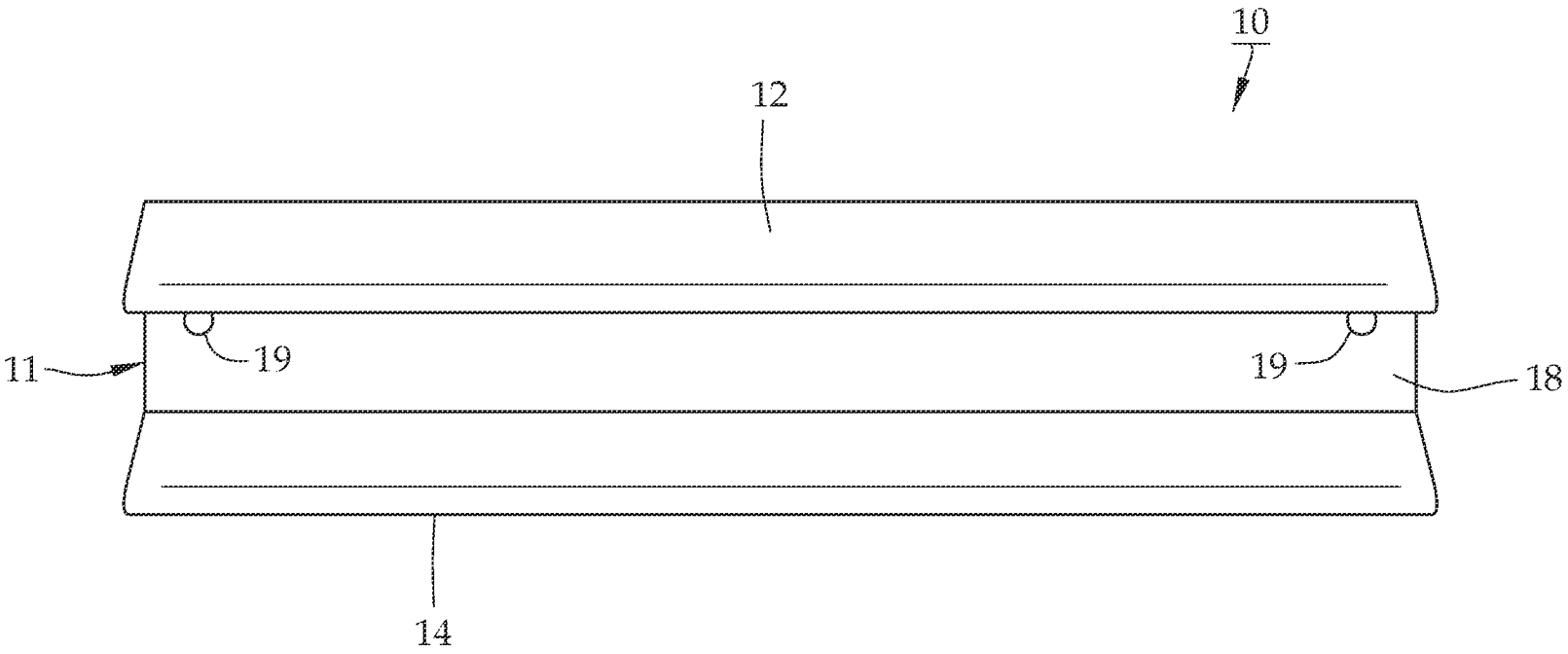
FIG. 4 demonstrates a top plan view of the mount of the noise reduction device for watercrafts.

Now referring to FIGS. 2, 3, and 4, the noise reduction device 50 comprises a mount 10 and a removable panel 30.

The mount 10 defines a base 11 and two opposing sidewalls 12, 14 extending from base 11. A bottom surface 17 of base 11 is attachable to a deck surface 101 of a watercraft 100. The base 11 defines a first longitudinal end 11*a* and a second longitudinal end 11*b*. A first sidewall 12 extends from first longitudinal end 11*a* and a second sidewall 14 extends from the second longitudinal end 11*b*. The base 11, first sidewall 12 and second sidewall 14 form channel 16. A top surface 18 of base 11 forms the bottom of the channel 16. The channel 16 is sized, shaped, and otherwise configured to receive the panel 30 therein. The panel 30 may be configured to reflect, absorb, and/or reduce sound waves away from a passenger (not shown) that may be positioned in a seating area 108 of a watercraft 100 and/or beyond a longitudinal axis defined by the first longitudinal end 11*a* in opposing relation to the motor 102.

Figure 6:
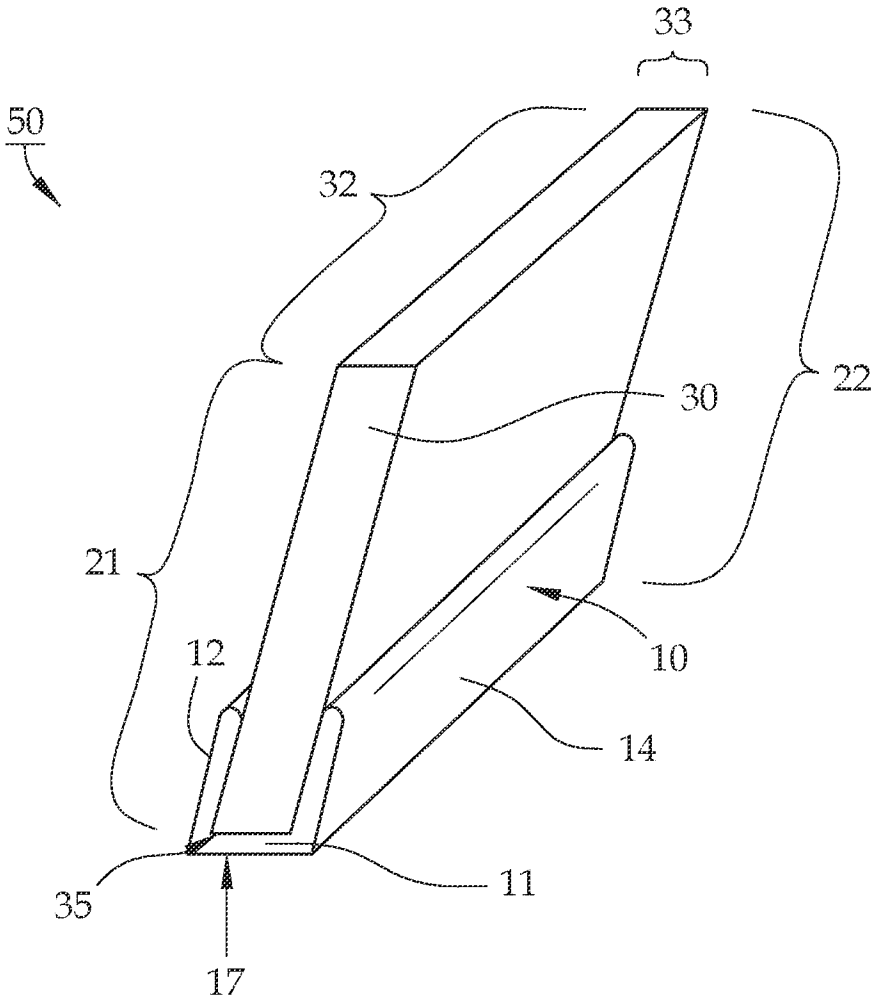
FIG. 6 features a perspective view of the noise reduction device for watercrafts.

In the preferred embodiment, the base 11 of mount 10 is shaped like an elongated rectangle. The first and second sidewalls 12, 14, are parallel and substantially the same length. The second sidewall 14 preferably forms an obtuse angle 15 relative to the top surface 18 of base 11 and the first sidewall 12 preferably forms an acute angle 13 relative to the top surface 18 of base 11. The acute angle 13 preferably ranges from sixty degrees to eighty-five degrees, and most preferably 70 degrees. The obtuse and acute angles 13, 15 are preferably supplementary angles. The noise reduction device 50 is positioned on the deck 101 of the watercraft 100 so that second sidewall 14 is nearest the motor 102. The side of second sidewall 14 that is nearest motor 102 preferably defines the front 22 of the device 50, whereas the side of the first sidewall 12 most distal from the motor 102 preferably defines the rear 21 of the device 50 as seen in FIG. 6. The panel 30 may be configured to reflect sound waves 70 away from the passenger positioned beyond the rear 21 of the device 50. In one or more embodiments, the panel 30 may be configured to reflect, absorb, or reduce sound waves 70 travelling toward a passenger (not shown) positioned beyond the rear 21 of the device 50 and/or positioned in the seating area 108 of the watercraft 100. In the preferred embodiment, at least one of the longitudinal ends 11*a*, 11*b* may define a length of about 30 inches (76.2 cm) (+/−5 inches). In one or more embodiments, a distance (not shown) between top surface 18 and bottom surface 17 is about 0.5 inches (1.27 cm) (+/−0.25 inches).

Generally, the motor 102 may define a top section 103 and a lower section 104, the top section 103 may be defined as the powerhead of the motor and the lower section 104 may include the exhaust housing, exhaust port, water intake, and propellor. Typically, the exhaust port may be located at the center of the propellor and may eject exhaust into the water surrounding the propellor, but this may not be the case for all motors. Despite the powerhead being located at the top section 103 of the motor 102, a majority of the noise generated by the motor may originate from the lower section 104 in many instances, and may specifically be derived from the exhaust port, the water intake, the propellor, vibrations, and the interactions with the lower section 104 and the water. In the preferred embodiment, the panel 30 is configured (sized, shaped, positioned, capable) to reflect sound waves 70 emanating from the lower section 104 and reduce noise reaching the passenger of the watercraft 100 positioned beyond the rear 21 of the device 50, opposite to the motor 102, and/or positioned in the seating area 108 of the watercraft 100. It should be understood that the lower sections of outboard motors may be responsible for significant noise generation, therefore it may be advantageous to reflect the sound waves away from seating areas of a boat. The preferred panel 30 may also be configured to reflect sound waves 70 so that the sound waves 70 are not channeled and/or intensified by a deployed awning 105 or bimini top 105. The preferred panel 30 may also be further configured to reduce noise reaching passengers generated by waves created by the motor 102, waves contacting a hull 109 of the watercraft 100, wind, other watercrafts and/or vehicles, and other noise travelling in the direction from the rear 106 to the front 107 of the watercraft.

In one or more embodiments, the panel 30 may be formed from a deformable material, such as but not limited to a foam species. Foam species may include but are not limited to charcoal foam, closed cell foam, dry fast foam, high density foam, high resilience foam, latex foam, lux foam, memory foam, polyurethane foam, polyester foam, polyether foam, ethafoam, and rebond foam. In one or more embodiments, the panel is formed from a deformable material selected from a group consisting of: charcoal foam, closed cell foam, dry fast foam, high density foam, high resilience foam, latex foam, lux foam, memory foam, polyurethane foam, polyester foam, polyether foam, ethafoam, and rebond foam. In some embodiments, the panel 30 may be formed from two or more layers of deformable material. In the preferred embodiment, the panel 30 may be coated with vinyl. It shall be understood to those skilled in the art that vinyl-coated panels 30 may exhibit increased capacity to reduce and/or reflect sound. Therefore, it may be desirable for one or more sides of the panel 30 to be vinyl-coated. It should be understood that the panel 30 may be coated or enveloped in other materials such as but not limited to rubber, marine vinyl fabric, canvas, batting. It should be further understood that the panel 30 may be formed from other materials as well such as but not limited to plastic, wood, rubber, composites, synthetic fibers, and combinations thereof. In alternate embodiments, the panel 30 may be fully deformable and inflatable with gases.

Figure 5:
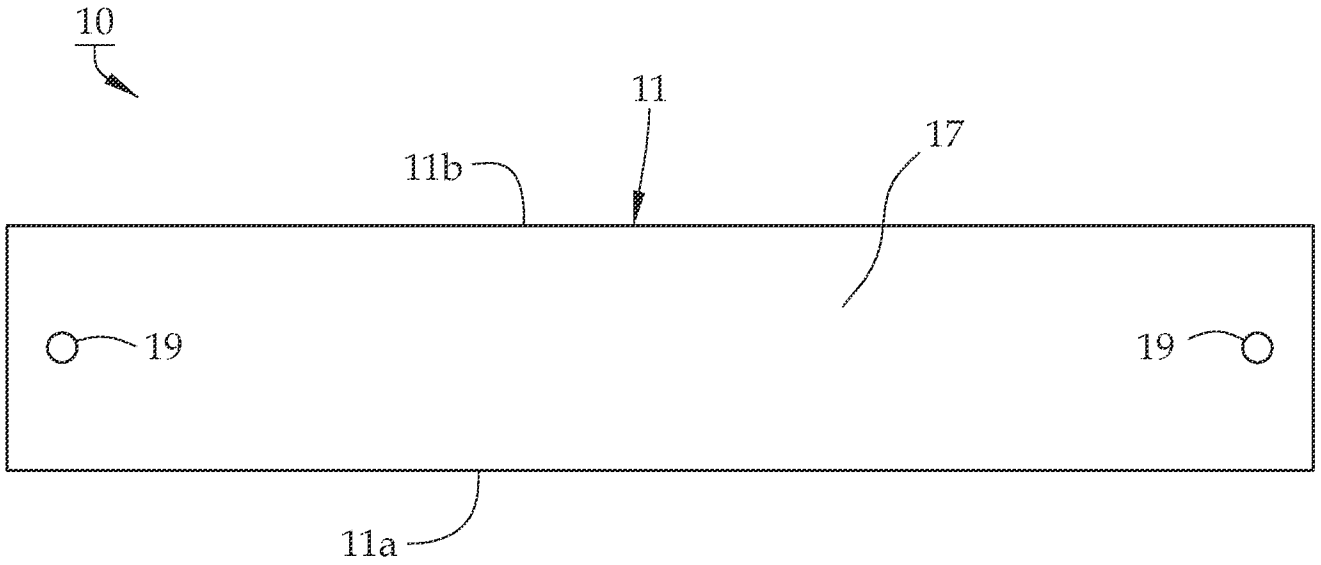
FIG. 5 illustrates a bottom plan view of the mount of the noise reduction device for watercrafts, showing the bottom surface of the elongated base.

FIG. 5 shows a bottom plan view of bottom surface 17 of mount 10. The bottom surface 17 is configured to be affixed or removably attached to the deck 101 of a watercraft 100. In the preferred embodiment, the base 11 of mount 10 defines a fastener hole 19 that is configured to receive a fastener 20 therein (see also FIGS. 2 and 4). The watercraft 100 may also include a corresponding fastener hole (not shown) so that the base 11 is attached to the deck 101 of the watercraft 100. In some embodiments the fastener hole 19 may be a through hole and in other embodiments the fastener hole 19 may be a blind hole. In alternative embodiments, the base 11 and deck 101 may include corresponding fasteners (not shown), such as but not limited to magnet fasteners, hook and loop fasteners, snap buttons, zippers and the like. Alternate embodiments that include the listed or similar fasteners may be desirable in situations where watercraft owners do not wish to drill a fastener hole through their watercraft and/or where watercraft owners would like to be able to more quickly remove the device 50 relative to the time in which it takes to remove fastener 20 from fastener hole 19 as seen in the preferred embodiment. Under certain circumstances, it may be desirable to weld the mount 10 to the deck 101 of the watercraft 100 to permanently affix the mount 10 to the watercraft 100. In instances where the mount 10 is to be welded to the deck 101 of the watercraft 100, the mount 10 may be formed from a metallic or other weldable material. It follows that in instances where the mount 10 is fastened or removably attached to the deck 101 of the watercraft 100, the mount 10 may be formed from any material such as but not limited to metal (such as but not limited to aluminum), plastic, wood, rubber, composites, synthetic fibers, and combinations thereof.

Now referring to FIGS. 2 and 6, the panel 30 defines a length 31, width 32, and thickness 33 and the noise reduction device 50 defines a height 34. In the preferred embodiment, the thickness 33 defines a value the same as, or slightly greater than (i.e. +/−1 inch) a distance 23 between the first and second sidewalls 12, 14, so that the panel 30 may be received by channel 16, and may preferably be slightly deformed so as to frictionally engage a portion of one or both of first and second sidewalls 12, 14. In some embodiments, the thickness 33 is 1.5 inches (3.81 cm) (+/−1 inch). In one or more embodiments, the first and/or second side walls 12, 14 may define a fastener hole (not shown) configured to receive a fastener therein (not shown); wherein the fastener, when fastened, is configured to secure the panel 30 while positioned within channel 16 reducing the chance that the panel 30 may be displaced at undesirable times when the watercraft 100 is in motion. In the preferred embodiment, the length 31 of the panel 30 is greater than or equal to eighteen (18) inches (45.72 cm). In the most preferred embodiment, the length 31 of the panel 30 is eighteen (18) inches. In alternate embodiments, the length 31 of the panel 30 may be less than eighteen (18) inches (45.72 cm) which may be desirable under some circumstances where the noise reduction device 50 is placed on an abnormally shaped watercraft or a pontoon boat that features lesser length, width, and/or depth dimensions relative to the average dimensions for commercially available pontoon boats. In one or more embodiments, the width 32 of the panel 30 may define a value of about 31 inches (78.74 cm) (+/−5 inches). In some embodiments, the height 34 of the noise reduction device 50 may define a value of about 17 inches (43.18 cm) (+/−5 inches) relative to the deck 101. In some embodiments, such as depicted in FIGS. 2 and 6, the panel 30 may be a rhombohedron. It may be desirable under some circumstances for the panel 30 to be a rhombohedron so that a bottom surface 35 of the panel 30 may be flush with the top surface 18 of the mount 10. In other embodiments, the panel 30 may be a rectangular prism. It should be understood that the shape of the panel 30 is not limited to six sided shapes, nor any specific geometry and may be formed in varying sizes including but limited to longer, wider, taller, and/or thicker for use on various sized watercrafts.

Although the noise reduction device 50 is discussed within this disclosure primarily for use in connection with watercrafts, it should be understood that the noise reduction device 50 may be used in connection with other types of vehicles such as aerial, terrestrial, and amphibious vehicles.

The illustrations and examples provided herein are for explanatory purposes and are not intended to limit the scope of the appended claims.

I claim:

1. A noise reduction device for watercrafts comprising:

a panel (30), said panel (30) configured to reflect sound emitting from a lower portion (104) of a motor (102) of a boat (100), said panel (30) formed from a deformable material;

a mount (10), said mount (10) defining a base (11), a first sidewall (12), and a second sidewall (14), said first and second sidewalls (12, 14) in opposing relation with one another; said base (11) defining a first longitudinal end (11*a*) and a second longitudinal end (11*b*) in opposing relation with one another; said first sidewall (12) extending from said first longitudinal end (11*a*) and said second sidewall (14) extending from said second longitudinal end (11*b*); said base (11), said first sidewall (12), and said second sidewall (14) defining a channel (16), said base (11) defining a top surface (18) and a bottom surface (17), said top surface (18) forming a bottom of said channel (16), the second sidewall (14) forming an obtuse angle (15) relative to said base (11); and wherein, said channel (16) is configured to receive said panel (30) therein.

2. The noise reduction device of claim 1, wherein said first and second sidewalls (12, 14) are parallel to one another.

3. The noise reduction device of claim 1, wherein said first and second sidewalls (12, 14) are parallel to one another and extend upwards relative to said base (11).

4. The noise reduction device of claim 1, wherein said first and second sidewalls (12, 14) are parallel to one another and extend upwards relative to said base (11); said second sidewall (14) forming the obtuse angle (15) relative to said top surface (18) of said base (11).

5. The noise reduction device of claim 1, wherein said first and second sidewalls (12, 14) are parallel to one another and extend upwards relative to said base (11); said second sidewall (14) forming the obtuse angle (15) relative to said top surface (18) of said base (11); said first sidewall (12) forming an acute angle (13) relative to said top surface (18) of said base (11).

6. The noise reduction device of claim 1, wherein said first and second sidewalls (12, 14) are parallel to one another and extend upwards relative to said base (11); said second sidewall (14) forming the obtuse angle (15) relative to said top surface (18) of said base (11); said first sidewall (12) forming an acute angle (13) relative to said top surface (18) of said base (11); and wherein said noise reduction device (50) is configured to be positioned on a deck (101) of a boat (100) so that said second sidewall (14) is positioned more proximate said motor (102) of said boat (100) than said first sidewall (12).

7. The noise reduction device of claim 1, wherein said first and second sidewalls (12, 14) are parallel to one another and extend upwards relative to said base (11); said second sidewall (14) forming the obtuse angle (15) relative to said top surface (18) of said base (11); said first sidewall (12) forming an acute angle (13) relative to said top surface (18) of said base (11); wherein said acute angle (13) relative to said base (11) is greater than sixty degrees; wherein said noise reduction device (50) is configured to be positioned on a deck (101) of said boat (100) so that said second sidewall (14) is positioned more proximate said motor (102) of said boat (100) than said first sidewall (12); and wherein a thickness (33) of said panel (30) is greater than a distance (23) between said first sidewall (12) and said second sidewall (14).

8. The noise reduction device of claim 1, wherein said first and second sidewalls (12, 14) are parallel to one another and extend upwards relative to said base (11); said second sidewall (14) forming the obtuse angle (15) relative to said top surface (18) of said base; said first sidewall (12) forming an acute angle (13) relative to said top surface (18) of said base (11); wherein said acute angle (13) relative to said base (11) is greater than sixty degrees; wherein said noise reduction device (50) is configured to be positioned on a deck (101) of said boat (100) so that said second sidewall (14) is positioned more proximate said motor (102) of said boat (100) than said first sidewall (12); and wherein a thickness (33) of said panel (30) is greater than a distance (23) between said first sidewall (12) and said second sidewall (14), said panel (30) and said channel (16) configured so that said panel (30) frictionally engages said channel (16) while inserted therein.

9. The noise reduction device of claim 1, wherein said first and second sidewalls (12, 14) are parallel to one another and extend upwards relative to said base (11); said second sidewall (14) forming the obtuse angle (15) relative to said top surface (18) of said base (11); said first sidewall (12) forming an acute angle (13) relative to said top surface (18) of said base (11); wherein said acute angle (13) relative to said base (11) is greater than sixty degrees; wherein said noise reduction device (50) is configured to be positioned on a deck (101) of said boat (100) so that said second sidewall (14) is positioned more proximate said motor (102) of said boat (100) than said first sidewall (12); wherein a thickness (33) of said panel (30) is greater than a distance (23) between said first and second sidewalls (12,14), said panel (30) and said channel (16) configured so that said panel (30) frictionally engages said channel (16) while inserted therein; and wherein a side of said second sidewall (14) nearest said motor (102) of said boat (100) defines said front (22) of said noise reduction device (50) and a side of said first sidewall (12) most distal said motor (102) of said boat (100) defines a rear (21) of said noise reduction device (50), said noise reduction device (50) is configured to reduce sound reaching a passenger beyond said rear (21) of said noise reduction device (50).

10. The noise reduction device of claim 9, wherein said noise reduction device (50) is configured to reflect sound traveling in a direction of a front (107) of said boat (100) from a rear (106) of said boat (100).

11. The noise reduction device of claim 10, wherein said panel (30) is formed from a species of foam selected from a list consisting of: charcoal foam, closed cell foam, latex foam, lux foam, memory foam, polyurethane foam, polyester foam, polyether foam, ethafoam, and rebond foam.

12. The noise reduction device of claim 11, wherein a side of said panel (30) is coated in vinyl.

13. The noise reduction device of claim 10, wherein a side of said panel (30) is coated in vinyl.

14. The noise reduction device of claim 10, wherein said noise reduction device (50) is configured to reflect sound generated from said lower portion (104) of said motor (102).

15. The noise reduction device of claim 10, wherein said noise reduction device (50) is configured to reflect and/or absorb noise generated from said lower portion (104) of said motor (102).

16. The noise reduction device of claim 10, wherein said noise reduction device (50) is configured to reflect sound generated from a top section (103) of said motor (102).

17. The noise reduction device of claim 10, wherein said noise reduction device (50) is configured to reflect and/or absorb sound generated from a top section (103) of said motor (102).

18. The noise reduction device of claim 10, wherein said noise reduction device (50) is configured to reflect sound generated from motor (102) that would have been funneled by a deployed awning (105) of said boat (100).

19. The noise reduction device of claim 13, wherein said bottom surface (17) of said base (11) defines a fastener hole (19) sized and shaped to receive a fastener (20) for removably attaching said mount (10) to said boat (100).

20. The noise reduction device of claim 13, wherein said bottom surface (17) of said base (11) and said deck (101) of said boat (100) include corresponding fasteners for removably attaching said mount (10) to said deck (101) of said boat (100).

* * * * *